US011703234B2

(12) United States Patent
Zhou

(10) Patent No.: US 11,703,234 B2
(45) Date of Patent: Jul. 18, 2023

(54) WINDOW AIR CONDITIONER

(71) Applicants: GD MIDEA AIR-CONDITIONING EQUIPMENT CO., LTD., Guangdong (CN); MIDEA GROUP CO., LTD., Guangdong (CN)

(72) Inventor: Junhua Zhou, Guangdong (CN)

(73) Assignees: GD MIDEA AIR-CONDITIONING EQUIPMENT CO., LTD., Guangdong (CN); MIDEA GROUP CO., LTD., Guangdong (CN)

( * ) Notice: Subject to any disclaimer, the term of this patent is extended or adjusted under 35 U.S.C. 154(b) by 371 days.

(21) Appl. No.: 16/890,014

(22) Filed: Jun. 2, 2020

(65) Prior Publication Data

US 2021/0164668 A1 Jun. 3, 2021

Related U.S. Application Data

(63) Continuation of application No. PCT/CN2020/072909, filed on Jan. 19, 2020.

(30) Foreign Application Priority Data

Nov. 28, 2019 (CN) ..... 201911196277.5
Nov. 28, 2019 (CN) ..... 201922096576.3

(51) Int. Cl.
*F24F 1/0358* (2019.01)
*F24F 1/027* (2019.01)
(Continued)

(52) U.S. Cl.
CPC ..... *F24F 1/0358* (2019.02); *F24F 1/027* (2013.01); *F24F 1/028* (2019.02); *F24F 1/031* (2019.02);
(Continued)

(58) Field of Classification Search
CPC ..... F24F 1/031; F24F 13/06; F24F 1/0323; F24F 13/30; F24F 1/027; F24F 13/20;
(Continued)

(56) References Cited

U.S. PATENT DOCUMENTS 2,940,281 A * 6/1960 Armstrong ..... F24F 1/0358 62/428
5,203,400 A * 4/1993 Tsunekawa ..... F24F 13/20 165/59

(Continued)

FOREIGN PATENT DOCUMENTS

CN 202254004 U * 5/2012
CN 202254004 U 5/2012

(Continued)

OTHER PUBLICATIONS

International Search Report and Written Opinion of the International Searching Authority dated Aug. 27, 2020 received in International Patent Application No. PCT/CN2020/072909 together with an English language translation.

*Primary Examiner* — Frantz F Jules
*Assistant Examiner* — Martha Tadesse
(74) *Attorney, Agent, or Firm* — Scully, Scott, Murphy & Presser, P.C.

(57) ABSTRACT

Disclosed is a window air conditioner having a constant temperature dehumidification mode. A first indoor heat exchanger and a second indoor heat exchanger of the air conditioner are stacked in an air inlet direction of an indoor air duct of the air conditioner. In the constant temperature dehumidification mode, one of the indoor heat exchangers is configured to be in a heating mode, and the other one is configured to be in a cooling mode. In this way, both fresh
(Continued)

air and indoor air may be dehumidified and heated, a user may feel the fresh air and the temperature of the dehumidified air is comfortable.

16 Claims, 6 Drawing Sheets

(51) Int. Cl.

| | |
|---|---|
| ***F24F 1/028*** | (2019.01) |
| ***F24F 1/031*** | (2019.01) |
| ***F24F 1/0323*** | (2019.01) |
| ***F24F 13/20*** | (2006.01) |
| ***F24F 13/30*** | (2006.01) |
| ***F24F 13/06*** | (2006.01) |

(52) U.S. Cl.
CPC ..... *F24F 1/0323* (2019.02); *F24F 13/06* (2013.01); *F24F 13/20* (2013.01); *F24F 13/30* (2013.01); *F24F 2013/202* (2013.01); *F24F 2013/205* (2013.01); *F24F 2221/20* (2013.01)

(58) Field of Classification Search
CPC .... F24F 1/028; F24F 1/0358; F24F 2013/205; F24F 2011/0002; F24F 2221/20; F24F 2013/202; F24F 1/037
See application file for complete search history.

(56) References Cited

U.S. PATENT DOCUMENTS

| | | | | | |
|---|---|---|---|---|---|
| 5,372,189 | A * | 12/1994 | Tsunekawa | ..... | F24F 1/027 165/59 |
| 2017/0176027 | A1* | 6/2017 | Eicher | ..... | F24F 13/28 |

FOREIGN PATENT DOCUMENTS

| | | | | |
|---|---|---|---|---|
| CN | 204313414 | U | * | 5/2015 |
| CN | 107192160 | A | | 9/2017 |
| CN | 207279831 | U | | 4/2018 |
| CN | 108489136 | A | | 9/2018 |
| CN | 110500648 | A | | 11/2019 |
| JP | H01-163534 | A | | 6/1989 |

* cited by examiner

WINDOW AIR CONDITIONER

CROSS-REFERENCE TO RELATED APPLICATIONS

The present disclosure claims the benefit of Chinese Patent application with No. 201911196277.5, filed on Nov. 28, 2019 and entitled "Window Air Conditioner", and Chinese Patent application with No. 201922096576.3, filed on Nov. 28, 2019 and entitled "Window Air Conditioner", the entirety of which is hereby incorporated herein by reference for all purposes. No new matter has been introduced.

FIELD

The present disclosure relates to the technical field of air conditioning, and in particular to a window air conditioner.

BACKGROUND

Nowadays, people have more and more demands for fresh air. There is also a strong demand for PTAC (Packaged Terminal Air Conditioner) window machine, which is the most commonly used refrigeration system for middle-end and high-end hotels in the U.S. market. However, now people not only require fresh air, but also put forward new demands for the comfort of fresh air. In this way, a number of PTACs with fresh air and fresh air dehumidification function have appeared on the market. However, for these PTACs, in order to meet the demand for fresh air dehumidification, only an independent dehumidification module has been added to the original air conditioning system, and it has not been integrated with the original refrigeration system. In this way, dual compressors and dual refrigeration systems must be used. That is, one air conditioner needs to be provided with two refrigeration systems, including two compressors, two motors, two evaporators, two condensers, and two capillaries. The disadvantages of this dual system are high cost, low energy efficiency, high noise, and poor production technology and efficiency.

Although the fresh air blowing to the indoor is dehumidified, since the volume of the fresh air is not very large, it cannot change the air effect in the entire room. Even if the PTAC has the dehumidification function turned on, the temperature of the dehumidified indoor air will be very low, which will make the user feel very uncomfortable.

The above content is only used to assist in understanding the technical solution of the disclosure, and does not mean that the above content is recognized as prior art.

SUMMARY

An aspect of the present disclosure provides a window air conditioner, which can solve one or more of the technical problems mentioned above.

The window air conditioner provided in this disclosure includes:

a casing, defining an indoor air duct;

an indoor heat exchanger, provided inside the casing and including:

a first indoor heat exchanger; and a second indoor heat exchanger; and, where:

the first indoor heat exchanger and the second indoor heat exchanger are configured to be stacked in an air inlet direction of the indoor air duct; and in the constant temperature dehumidification mode, one of the first indoor heat exchanger and the second indoor heat exchanger is configured to be in a heating mode, and the other one of the first indoor heat exchanger and the second indoor heat exchanger is configured to be in a cooling mode; and a fresh air device, configured to deliver fresh air to the indoor air duct and including:

a fresh air inlet, communicating with outdoor air;

a fresh air outlet, communicating with the indoor air duct; and a fresh air duct, communicating the fresh air inlet and the fresh air outlet.

In an embodiment, the casing includes:

an indoor casing, where:

the indoor casing defines the indoor air duct;

the fresh air outlet is configured to be defined on a rear side wall surface of the indoor casing;

an indoor air inlet is configured to be defined on a front side wall surface of the indoor casing; and the first indoor heat exchanger and the second indoor heat exchanger are configured to be stacked in a front-rear direction of the casing.

In an embodiment, a heat exchange surface of the first indoor heat exchanger is provided corresponding to the indoor air inlet.

In an embodiment, the window air conditioner further includes:

an outdoor air duct, defined inside the casing, an air outlet side of the outdoor air duct being configured to be in communication with the fresh air duct;

an outdoor heat exchanger, provided inside the outdoor air duct; and an outdoor fan, provided inside the outdoor air duct and configured to send air into the outdoor air duct and the fresh air duct.

In an embodiment, where:

the casing further includes:

an outdoor casing, defining the outdoor air duct; and the fresh air device includes:

a fresh air casing, defining the fresh air duct; and, where:

the fresh air casing is configured to be connected to the outdoor casing, and the fresh air inlet is configured to be defined at a junction between the fresh air casing and the outdoor casing.

In an embodiment, the window air conditioner further includes an air guide louver provided at the fresh air inlet.

In an embodiment, the fresh air casing is provided between the outdoor heat exchanger and the indoor heat exchanger.

In an embodiment, an air-passing area of the fresh air inlet of the fresh air casing is configured to be smaller than an air-passing area of the fresh air outlet of the fresh air casing.

In an embodiment, the fresh air casing is configured to be at least partially gradually expanded from the fresh air inlet to the fresh air outlet.

In an embodiment, at least one inner side wall surface of the fresh air casing is configured to be a curved surface, and the curved surface is configured to be recessed from an outside of the fresh air casing toward an inside of the fresh air casing.

In an embodiment, the fresh air device includes: a fresh air fan, provided inside the fresh air duct and configured to introduce airflow from the fresh air inlet to the indoor air duct.

In an embodiment, the window air conditioner further includes:

a chassis, the fresh air device being installed on the chassis; and a compressor, installed on the chassis; and, where:

the fresh air device is configured to be located on one side of the chassis in a longitudinal direction of the chassis, and the compressor is configured to be located on the other side of the chassis in the longitudinal direction of the chassis.

In an embodiment, the casing includes:

two opposite side walls, at least one of the two opposite side walls defining an outdoor air inlet communicating with an air inlet end of the outdoor air duct; and a rear end wall, connecting the two opposite side walls and defining an outdoor air outlet communicating with an air outlet end of the outdoor air duct.

In an embodiment, the window air conditioner further includes:

an indoor fan, provided inside the indoor air duct; and, where:

the casing further includes:

an indoor air inlet, communicating with the indoor air duct; and an indoor air outlet, communicating with the indoor air duct and located above the indoor air inlet.

In an embodiment, an angle between an air supply direction of the indoor air outlet and a horizontal plane is configured to be greater than 0 degrees and less than 90 degrees.

In an embodiment, the casing includes: an indoor casing, defining the indoor air duct, the indoor air outlet being located on a top and/or lateral side of the indoor casing.

In an embodiment, the window air conditioner further includes:

a compressor;

an outdoor heat exchanger;

a refrigerant circulation pipe;

a discharge pipe, provided at a refrigerant outlet of the compressor; and a suction pipe, provided at a refrigerant inlet of the compressor; and, where:

the discharge pipe, the outdoor heat exchanger, the first indoor heat exchanger, the second indoor heat exchanger, and the suction pipe are configured to be sequentially communicated with one another through the refrigerant circulation pipe.

In an embodiment, the refrigerant circulation pipe includes:

a first piping, connecting the discharge pipe and the outdoor heat exchanger; and a second piping, connecting the suction pipe and the second indoor heat exchanger; and, where:

the window air conditioner further includes:

a switch, serially connected to the first piping and the second piping and having a first switching state and a second switching state; and, where:

in the first switching state, the first piping connected to two ends of the switch is configured to be turned on, and the second piping connected to another two ends of the switch is configured to be turned on; and in the second switching state, the first piping between the discharge pipe and the switch is configured to be in communication with the second piping between the switch and the second indoor heat exchanger, and the first piping between the outdoor heat exchanger and the switch is configured to be in communication with the second piping between the suction pipe and the switch.

In an embodiment, the window air conditioner further includes:

a refrigerant radiator, serially connected to the refrigerant circulation pipe between the outdoor heat exchanger and the first indoor heat exchanger;

a one-way throttle valve, serially connected to the refrigerant circulation pipe between the outdoor heat exchanger and the refrigerant radiator, an inlet of the one-way throttle valve being adjacent to the refrigerant radiator, an outlet of the one-way throttle valve being adjacent to the outdoor heat exchanger;

a first one-way valve; and a second one-way valve; and, where:

the refrigerant circulation pipe further includes:

a third piping, connecting the refrigerant radiator and the first indoor heat exchanger; and a fourth piping, connecting the refrigerant radiator and the first indoor heat exchanger and arranged in parallel with the third piping; and, where:

the first one-way valve is configured to be serially connected to the third piping, an inlet of the first one-way valve being adjacent to the refrigerant radiator, an outlet of the first one-way valve being adjacent to the first indoor heat exchanger; and the second one-way valve is configured to be serially connected to the fourth piping, an inlet of the second one-way valve being adjacent to the first indoor heat exchanger, an outlet of the second one-way valve being adjacent to the refrigerant radiator.

Regarding the window air conditioner of the present disclosure, the first indoor heat exchanger and the second indoor heat exchanger are stacked in the air inlet direction of the indoor air duct, and the heat exchange modes of the first indoor heat exchanger and the second indoor heat exchanger may be reversed, and at the same time, the fresh air outlet of the fresh air duct communicates with the indoor duct. In this way, the first indoor heat exchanger and the second indoor heat exchanger may be set to one in the cooling mode and the other in the heating mode. In this way, both fresh air and indoor air may be dehumidified and heated, not only all the indoor air is dehumidified again with improving the dehumidification efficiency, but also the purpose of constant temperature dehumidification is achieved, so that the entire indoor temperature of the window air conditioner will not drop in the dehumidification mode, so that the user may feel the fresh air, and the temperature of the dehumidified air is very comfortable, and there will be no cool feeling. At the same time, the indoor heat exchanger can be fully utilized during dehumidification, and there is no need to additionally install a fresh air condenser and a fresh air evaporator, which greatly reduces the manufacturing cost and power.

BRIEF DESCRIPTION OF THE DRAWINGS

In order to explain the technical solutions in the embodiments of the present disclosure or the prior art more clearly, the drawings used in the description of the embodiments or the prior art will be briefly introduced below. Obviously, the drawings in the following description are merely some embodiments of the present disclosure. For those of ordinary skill in the art, other drawings can be obtained according to the structure shown in the drawings without creative efforts.

DESCRIPTION OF REFERENCE NUMERALS

Figure 1:
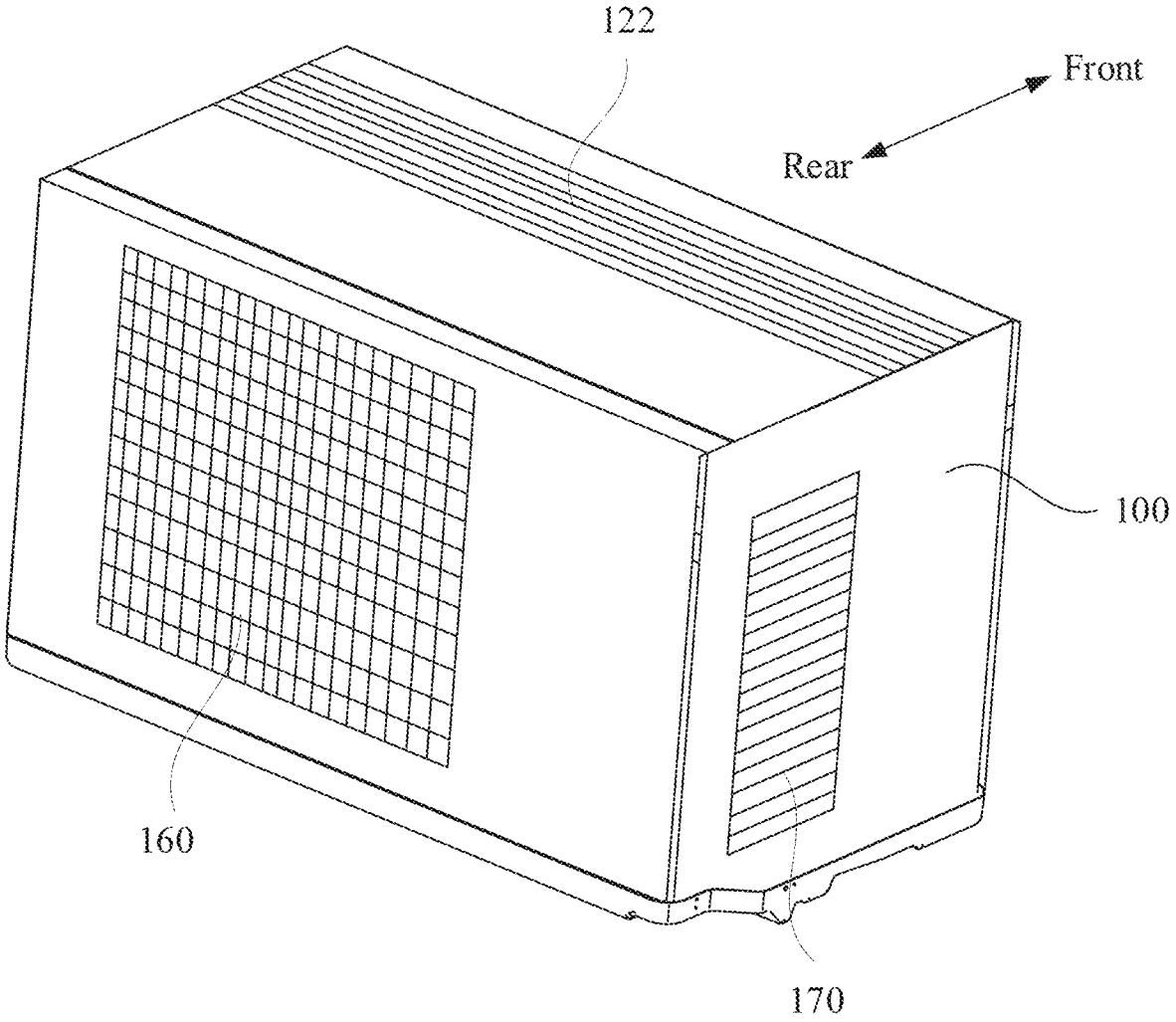
FIG. 1 is a schematic structural view of a window air conditioner according to an embodiment of the present disclosure.

| Reference numeral | Name |
|---|---|
| 100 | Casing |
| 110 | Indoor air duct |
| 120 | Indoor casing |
| 121 | Indoor air inlet |
| 122 | Indoor air outlet |
| 123 | Indoor fan |
| 130 | Outdoor air duct |
| 140 | Outdoor casing |
| 150 | Chassis |
| 160 | Outdoor air outlet |
| 170 | Outdoor air inlet |
| 200 | Indoor heat exchanger |
| 210 | First indoor heat exchanger |
| 220 | Second indoor heat exchanger |
| 300 | Fresh air device |
| 310 | Fresh air inlet |
| 320 | Fresh air outlet |
| 330 | Fresh air duct |
| 340 | Fresh air casing |
| 341 | Curved surface |
| 400 | Outdoor heat exchanger |
| 500 | Outdoor fan |
| 600 | Compressor |
| 610 | Discharge pipe |
| 620 | Suction pipe |
| 710 | First piping |
| 720 | Second piping |
| 730 | Third piping |
| 740 | Fourth piping |
| 800 | Switch |
| 900 | Refrigerant radiator |
| 910 | One-way throttle valve |
| 920 | First one-way valve |
| 930 | Second one-way valve |

-continued

| Reference numeral | Name |
|---|---|
| 940 | First valve |
| 950 | Second valve |

The implementation, functional characteristics and advantages of the present disclosure will be further described in conjunction with the embodiments and with reference to the drawings.

DETAILED DESCRIPTION OF THE EMBODIMENTS

It should be noted that if there is a directional indicator (such as up, down, left, right, front, back, etc.) in the embodiment of the present disclosure, the directional indication is only used to explain the relative positional relationship, movement, etc. of the various components in a specific posture (as shown in the drawings), if the specific posture changes, the directional indicator will change accordingly.

In addition, if there are descriptions related to "first", "second", etc. in the embodiments of the present disclosure, the descriptions of "first", "second", etc. are only used for description purposes, and cannot be understood to indicate or imply its relative importance or to imply the number of technical features indicated. Therefore, the features defined as "first" and "second" may explicitly or implicitly include at least one of the features. In addition, the meaning of "and/or" appearing throughout the text is to include three parallel solutions. Taking "A and/or B" as an example, it includes solution A, or solution B, or solution that both A and B satisfy.

This disclosure provides a window air conditioner.

In an embodiment of the present disclosure, as shown in FIGS. 1 to 6, the window air conditioner includes a casing 100, an indoor heat exchanger 200 and a fresh air device 300. An indoor air duct 110 is defined inside the casing 100. The indoor heat exchanger 200 is provided inside the casing 100. The indoor heat exchanger 200 includes a first indoor heat exchanger 210 and a second indoor heat exchanger 220, which are stacked in an air inlet direction of the indoor air duct 110. The window air conditioner has a constant temperature dehumidification mode. In the constant temperature dehumidification mode, one of the first indoor heat exchanger 210 and the second indoor heat exchanger 220 is in a heating mode, and the other one of the first indoor heat exchanger 210 and the second indoor heat exchanger 220 is in a cooling mode. The fresh air device 300 is configured to deliver fresh air to the indoor air duct 110. The fresh air device 300 includes a fresh air inlet 310 communicating with outdoor air or outdoor environment, a fresh air outlet 320 communicating with the indoor air duct 110, and a fresh air duct 330 communicating the fresh air inlet 310 and the fresh air outlet 320.

In this embodiment, the shape of the casing 100 may be square, cylindrical, or the like, which may be selected according to specific application requirements, and is not specifically limited herein. Generally, in order to facilitate manufacturing and molding, the shape of the casing 100 can be substantially square. The cross-sectional shape of the indoor air duct 110 may be rectangular, circular, irregular, etc., which is not specifically limited herein. The extending direction of the indoor air duct 110 generally coincides with the longitudinal direction of the casing 100. It should be noted that the first indoor heat exchanger 210 and the second indoor heat exchanger 220 are stacked, and the heat exchange surfaces of the two may be closely arranged, or may have a certain gap therebetween.

It can be understood that the casing 100 defines an indoor air inlet 121 and an indoor air outlet 122. An air inlet end of the indoor air duct 110 communicates with the indoor air inlet 121, and an air outlet end of the indoor air duct 110 communicates with the indoor air outlet 122. Both the indoor air inlet 121 and the indoor air outlet 122 may be defined on a front side wall surface of the casing 100. Alternatively, the indoor air inlet 121 can be located on the front side wall surface of the casing 100, and the indoor air outlet 122 can be located on a top surface of the casing 100. Alternatively, the indoor air outlet 122 may also be located at a junction of the front side wall surface and the top surface of the casing 100. The indoor air inlet 121 may be defined on a left side wall surface and/or a right side wall surface of the casing 100. It may be selected and designed according to the usage requirements and the type of an indoor fan 123. The indoor fan 123 may also be provided inside the indoor air duct 110, and the indoor fan 123 may be a centrifugal fan or a cross-flow fan. By stacking the first indoor heat exchanger 210 and the second indoor heat exchanger 220 in the air inlet direction of the indoor air duct 110, the fresh air flow from the fresh air duct 330 may be firstly blown out from the indoor air outlet 122 under the action of the indoor fan 123. The fresh air is mixed with the indoor air in the room. Afterwards, the mixed air flow is introduced from the indoor air inlet 121 by the indoor fan 123, and sequentially passes through the first indoor heat exchanger 210 and the second indoor heat exchanger 220. Finally, the processed air is blown out through the indoor air outlet 122. In this way, the air conditioner can not only implement constant temperature dehumidification for fresh air, but also implement circulating constant temperature dehumidification for indoor air, achieving better overall constant temperature dehumidification effect.

In an embodiment, the casing 100 further defines the indoor air inlet 121 communicating with the indoor air duct 110 and the indoor air outlet 122 communicating with the indoor air duct 110. The indoor fan 123 is provided inside the indoor air duct 110, and the indoor air outlet 122 is located above the indoor air inlet 121. In this way, both the indoor air inlet 121 and the indoor air outlet 122 may be defined on the front side wall surface of the casing 100, and the indoor air outlet 122 may be located above the indoor air inlet 121. Alternatively, the indoor air inlet 121 may be defined on the front side wall surface of the casing 100, and the indoor air outlet 122 may be defined on the top surface of the casing 100. Alternatively, the indoor air inlet 121 may be defined on the front side wall surface of the casing 100, and the indoor air outlet 122 may be defined at the junction of the front side wall surface and the top surface of the casing 100, so that air is blown out from the air outlet obliquely upwardly. By making the indoor air outlet 122 above the indoor air inlet 121, on the one hand, it is convenient for the indoor heat exchanger 200 to correspond to the indoor air inlet 121; and on the other hand, when the indoor fan 123 sends fresh air from the indoor air outlet 122, since the humidity of the fresh air is large, the fresh air flow from the indoor air outlet 122 will flow downwardly. As a result, the mixing effect of the fresh air and the indoor air is satisfactory, and the fresh air can be more readily drawn into the indoor air duct 110 by the indoor fan 123 from the indoor air inlet 121 below the indoor air outlet 122 for constant temperature dehumidification.

For example, an angle between an air supply direction of the indoor air outlet 122 and a horizontal plane is greater than 0 degrees and less than 90 degrees. Then, the air blowing direction of the indoor air outlet 122 is obliquely upward. For example, the angle between the air supply direction of the indoor air outlet 122 and the horizontal plane may be 10 degrees, 20 degrees, 35 degrees, 45 degrees, 60 degrees, 70 degrees, 80 degrees, and so on. By making the indoor air outlet 122 blow air obliquely upwardly, on the one hand, the air may be prevented from blowing directly to the user and the ceiling; and on the other hand, the airflow may be blown farther. As a result, the mixing effect is satisfactory, and the indoor temperature distribution is more uniform. Optionally, the angle between the air supply direction of the indoor air outlet 122 and the horizontal plane can be 45 degrees. In this way, it is easy to mold and manufacture, and makes the overall consistency better.

The fresh air inlet 310 and the fresh air outlet 320 may be rectangular, circular, elongated, elliptical, or of a plurality of micro-holes, which are not specifically limited herein. The fresh air device 300 is configured to supply fresh air to the indoor air duct 110, and a fresh air fan may be provided inside the fresh air duct 330 to introduce airflow from the fresh air inlet 310 into the indoor air duct 110. It is also possible to use only the negative pressure of the indoor fan 123 to press the outdoor air flow into the indoor air duct 110. At this time, the fresh air outlet 320 should be defined on an air inlet side of the indoor fan 123. An indoor temperature sensing device and a humidity sensing device may be used to judge whether cooling or constant temperature dehumidification is needed by the window air conditioner.

It should be noted that in addition to the constant temperature dehumidification mode, the window air conditioner may also have modes, such as, individual cooling and individual heating. When the window air conditioner is in the constant temperature dehumidification mode, the first indoor heat exchanger 210 may be in a cooling mode (acting as an evaporator), and the second indoor heat exchanger 220 may be in a heating mode (acting as a condenser), or the first indoor heat exchanger 210 may be in the heating mode, and the second indoor heat exchanger 220 may be in the cooling mode. In this way, when the fresh air enters the indoor air duct 110 and is blown out by the indoor air outlet 122, the mixed air flow of the indoor air and the fresh air may be sucked into the indoor air duct 110 by the indoor fan 123 again, and then dehumidified/heated by the first indoor heat exchanger 210, and heated/dehumidified by the second indoor heat exchanger 220. Thus, the purpose of constant temperature dehumidification is achieved, so that the indoor air and fresh air may reach a comfortable temperature after dehumidification. In order to improve the dehumidification effect, the air flow is heated by the condenser first, and subsequently dehumidified by the evaporator. That is, in the constant temperature dehumidification mode, the first indoor heat exchanger 210 acts as a condenser, and the second indoor heat exchanger 220 acts as an evaporator.

It can be understood that the heat exchange modes of the first indoor heat exchanger 210 and the second indoor heat exchanger 220 may also be the same, so that when the window air conditioner needs to be cooled or heated separately, the first indoor heat exchanger 210 and the second heat exchanger 220 may be both in the cooling mode (simultaneously acting as evaporators) or the heating mode (simultaneously acting as condensers). In this way, after dual-cooled or dual-heated by the first indoor heat exchanger 210 and the second indoor heat exchanger 220, the indoor air may be quickly cooled or heated to meet the needs of users for rapid cooling or heating.

Regarding the window air conditioner of the present disclosure, the first indoor heat exchanger 210 and the second indoor heat exchanger 220 are stacked in the air inlet direction of the indoor air duct 110, and the heat exchange modes of the first indoor heat exchanger 210 and the second indoor heat exchanger 220 may be reversed, and at the same time, the fresh air outlet 320 of the fresh air duct 330 communicates with the indoor duct 110. In this way, the first indoor heat exchanger 210 and the second indoor heat exchanger 220 may be set, such that one indoor heat exchanger is in the cooling mode and the other indoor heat exchanger is in the heating mode. In this way, both fresh air and indoor air may be dehumidified and heated. Thus, all the indoor air can be dehumidified again, which improves the dehumidification efficiency. Moreover, constant temperature dehumidification can be achieved, so that the entire indoor temperature of the window air conditioner will not drop in the dehumidification mode. Therefore, the user may feel the fresh air, and the temperature of the dehumidified air is comfortable, and there will be no cool feeling. At the same time, the indoor heat exchangers may be fully utilized during dehumidification, and there is no need to additionally install a fresh air condenser and a fresh air evaporator, which greatly reduces the manufacturing cost and the entire power requirement of the air conditioner. At the same time, a compressor 600 may be used for the dehumidification system and the heat exchange system, so that the whole machine occupies less space, the noise is small, and the production process and efficiency are improved.

Figure 2:
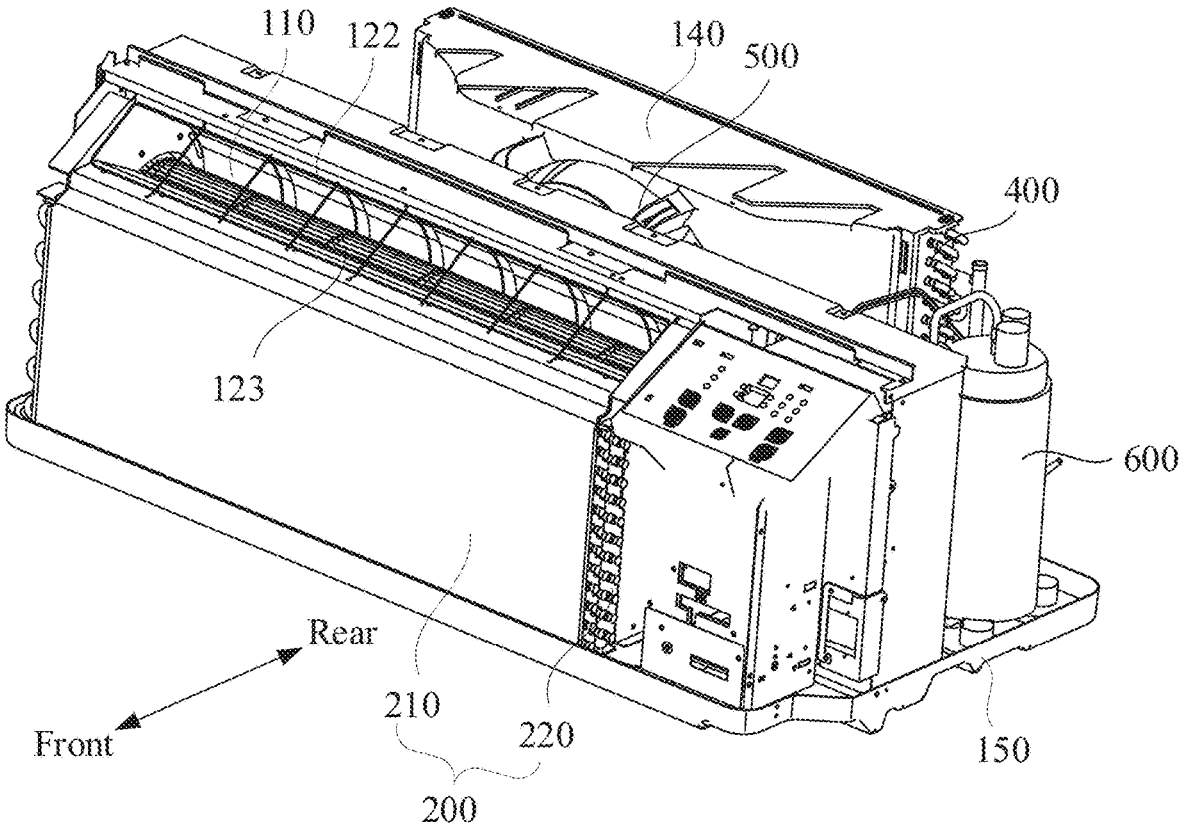
FIG. 2 is a schematic structural view of the window air conditioner according to another embodiment of the present disclosure, in which a casing of the window air conditioner is removed.
Figure 3:
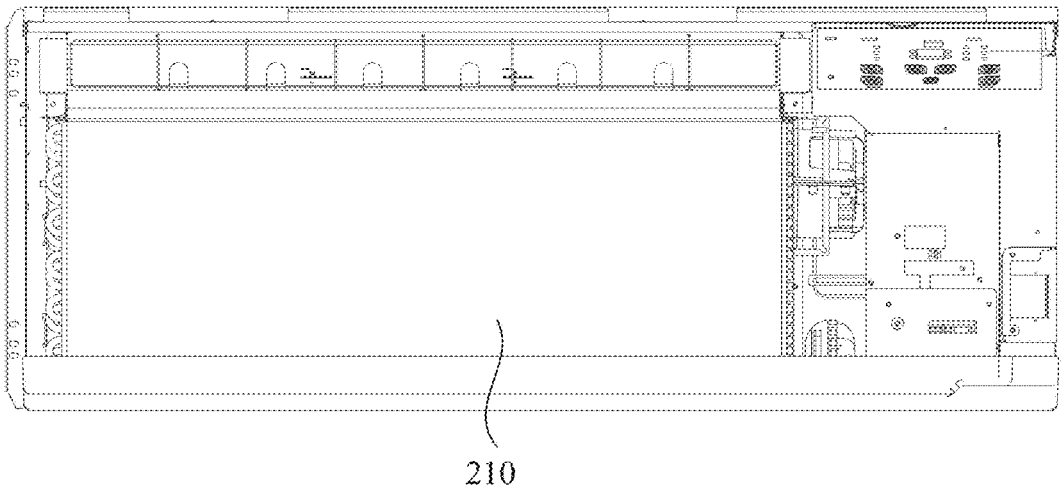
FIG. 3 is a schematic front view of the window air conditioner in FIG. 2.
Figure 6:
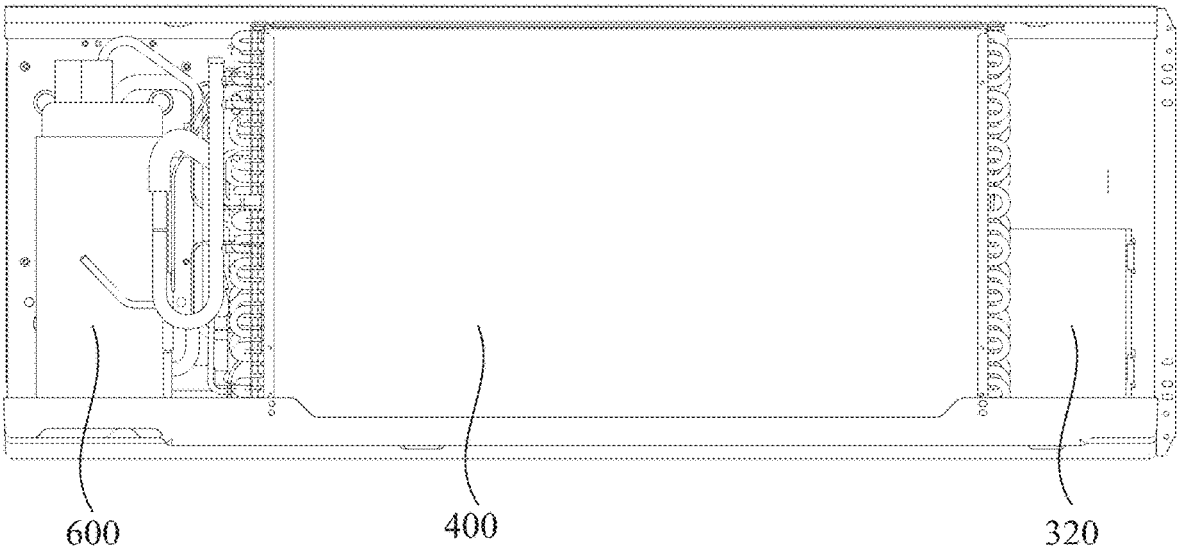
FIG. 6 is a schematic rear view of the window air conditioner in FIG. 3.

Referring to FIGS. 2 and 6, the casing 100 includes an indoor casing 120. The indoor casing 120 defines the indoor air duct 110. The fresh air outlet 320 is defined on a rear side wall surface of the indoor casing 120. The indoor air inlet 121 is defined on a front side wall surface of the indoor casing 120. The first indoor heat exchanger 210 and the second indoor heat exchanger 220 are stacked in a front-rear direction of the casing 100.

In this embodiment, the indoor casing 120 may be directly defined by a part of the casing 100. Alternatively, the casing 100 may be a separate structure, and in this case, the indoor casing 120 is provided inside the casing 100. The fresh air outlet 320 and the indoor air inlet 121 may be rectangular, circular, elongated, elliptical, or of a plurality of micro-holes, which are not specifically limited herein. By defining the indoor air inlet 121 on the front side wall surface of the casing 100 and defining the fresh air outlet 320 on the rear side wall surface of the indoor casing 120, the fresh air outlet 320 and the indoor air inlet 121 are arranged oppositely, and both are located at the air inlet side of the indoor fan 123. In this way, fresh air and indoor air may be more effectively drawn into the indoor air duct 110 by the indoor fan 123 for heat exchange. Moreover, the indoor air inlet 121 is defined on the front side wall surface, so that a large amount of indoor airflow may flow into the indoor air duct 110. The heat exchange surface of the first indoor heat exchanger 210 may be provided corresponding to the indoor air inlet 121, so that the airflow flowing in from the air inlet may quickly flow into the first indoor heat exchanger 210 and the second indoor heat exchanger 220 for heat exchange. By stacking the first indoor heat exchanger 210 and the second indoor heat exchanger 220 in the front-rear direction of the casing 100, the overall structure may be more compact, thereby reducing the space occupied by the indoor heat exchanger 200 and further reducing the overall volume. The indoor air outlet 122 may be defined on a top side and/or a lateral side of the indoor casing 120.

Figure 4:
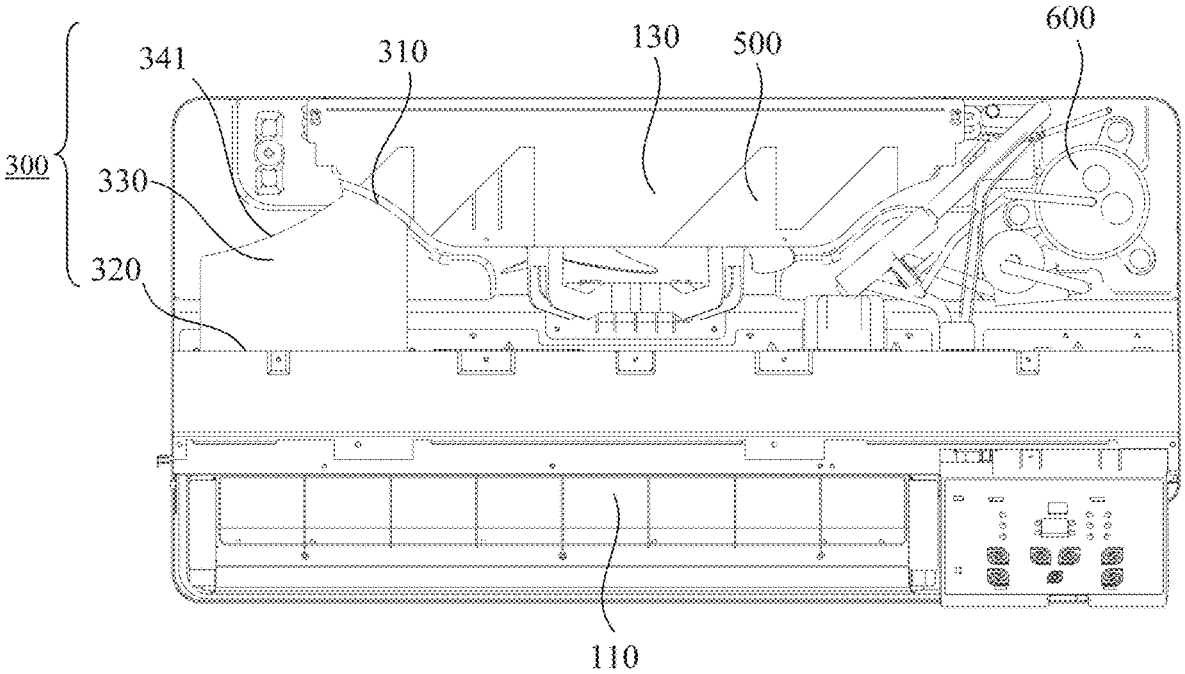
FIG. 4 is a schematic top view of the window air conditioner in FIG. 3.
Figure 5:
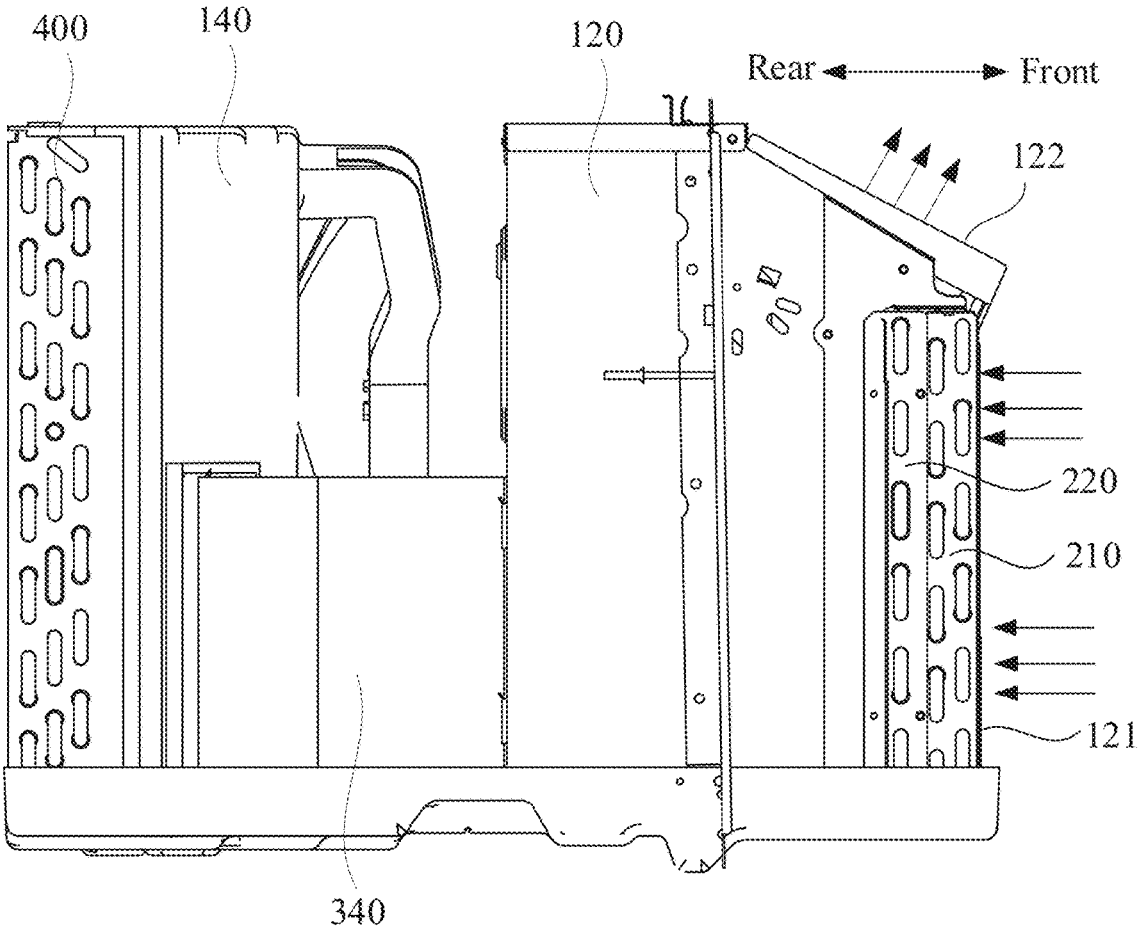
FIG. 5 is a schematic left side view of the window air conditioner in FIG. 3.

In one embodiment, as shown in FIGS. 4 and 5, an outdoor air duct 130 is further defined inside the casing 100, and an air outlet side of the outdoor air duct 130 is configured to be in communication with the fresh air duct 330. The window air conditioner further includes an outdoor heat exchanger 400 provided inside the outdoor air duct 130, and an outdoor fan 500 provided inside the outdoor air duct 130 and configured to send air into the outdoor air duct 130 and the fresh air duct 330.

In this embodiment, it can be understood that the casing 100 defines an outdoor air inlet 170 and an outdoor air outlet 160, an air inlet end of the outdoor air duct 130 communicates with the outdoor air inlet 170, and an air outlet end of the outdoor air duct 130 communicates with the outdoor air outlet 160. The cross-sectional shape of the outdoor air duct 130 may be rectangular, circular, irregular, etc., which is not specifically limited herein. The extending direction of the outdoor air duct 130 generally coincides with the longitudinal direction of the casing 100. The outdoor fan 500 may be an axial fan. The air outlet side of the outdoor air duct 130 refers to an air outlet end of the outdoor fan 500. By communicating the air outlet side of the outdoor air duct 130 with the fresh air duct 330, the outdoor fan 500 may be fully utilized, and the outdoor airflow may be blown to the outdoor air outlet 160 while being blown to the fresh air duct 330 by the outdoor fan 500. In this way, there is no need to additionally install a fresh air fan in the fresh air duct 330, which avoids an additional fan and reduces the overall cost. The airflow flowing into the fresh air duct 330 through the outdoor air duct 130 may be the airflow after heat exchange through the outdoor heat exchanger 400 or the airflow before heat exchange. If the airflow flowing into the fresh air duct 330 is the airflow after heat exchange through the outdoor heat exchanger 400, the airflow may also be heated, and the power of the indoor condenser does not need to be set high, thereby improving energy efficiency.

In an embodiment, as shown in FIG. 1, the casing includes two opposite side walls and a rear end wall connecting the two opposite side walls. The rear end wall defines an outdoor air outlet 160 communicating with an air outlet end of the outdoor air duct 130. At least one of the two opposite side walls defines an outdoor air inlet 170 communicating with an air inlet end of the outdoor air duct 130. In this way, the airflow enters from the outdoor air inlet 170 on the side wall of the casing 100 and is sucked into the outdoor air duct 130 by the outdoor fan 500 to radiate heat to the outdoor heat exchanger 400 and then flows out of the outdoor air outlet 160. This makes the arrangement of the outdoor air inlet 170 and the outdoor air outlet 160 more reasonable. In other embodiments, the outdoor air inlet 170 may also be defined on the rear end wall.

Referring to FIGS. 5 and 6, the casing 100 further includes an outdoor casing 140, and the outdoor casing 140 defines the outdoor air duct 130. The fresh air device 300 includes a fresh air casing 340, and the fresh air casing 340 defines the fresh air duct 330. The fresh air casing 340 is configured to be connected to the outdoor casing 140, and the fresh air inlet 310 is configured to be defined at a location where the fresh air casing 340 and the outdoor casing 140 are connected. The outdoor casing 140 may be directly defined by a part of the casing 100. Alternatively, the casing 100 may be a separate structure, and in this case, the outdoor casing 140 is provided inside the casing 100. An inner cavity of the fresh air casing 340 defines the fresh air duct 330. The cross-sectional shape of the fresh air duct 330 may be rectangular, circular, elliptical, etc., which is not specifically limited herein. The shape of the fresh air inlet 310 may be circular, rectangular, elliptical, etc., which is not specifically limited herein. The fresh air inlet 310 is defined at a location where the fresh air casing 340 and the outdoor casing 140 are connected. The airflow inside the fresh air duct 330 all flows in from the outdoor air duct 130, so that the outdoor fan 500 drives the fresh air into the fresh air duct 330 with a better effect. Optionally, in order to facilitate the introduction of fresh air, an air guide louver may be provided at the fresh air inlet 310.

In an embodiment, as shown in FIGS. 4 and 5, the fresh air casing 340 is provided between the outdoor heat exchanger 400 and the indoor heat exchanger 200. By disposing the fresh air casing 340 between the outdoor heat exchanger 400 and the indoor heat exchanger 200, on the one hand, the overall structure is more compact, and the space inside the casing 100 is used more efficiently; on the other hand, the length of the fresh air duct 330 can be reduced, that is, the path of fresh air flowing from the outdoor air duct 130 to the indoor air duct 110 is shorter, so that the air loss is reduced, the air speed and the air volume are increased, and the airflow inflow frequency is faster.

On the basis of the foregoing embodiments, further referring to FIG. 4, an air-passing area of the fresh air inlet 310 of the fresh air casing 340 is smaller than an air-passing area of the fresh air outlet 320 of the fresh air casing 340. In this way, the air-passing area of the fresh air outlet 320 can be increased, so that enough fresh air may be blown toward the indoor air duct 110. The air-passing area of the fresh air inlet 310 is small, so that the installation of the fresh air casing 340 and the outdoor casing 140 may be facilitated.

Further, the fresh air casing 340 is configured to be at least partially gradually expanded from the fresh air inlet 310 to the fresh air outlet 320. The fresh air casing 340 may be gradually expanded from the fresh air inlet 310 to the fresh air outlet 320, or may only be gradually expanded in the middle section, the section near the fresh air inlet 310 or the section near the fresh air outlet. By making the fresh air casing 340 at least partially gradually expanded, when the fresh air flows from the fresh air inlet 310 to the fresh air outlet 320, the flow may be expanded at the gradually expanding section, thereby effectively reducing noise, allowing the air flow more smoothly, and meets the needs of fresh air flow.

In an embodiment, referring to FIG. 4 again, at least one inner side wall surface of the fresh air casing 340 is configured to be a curved surface 341, and the curved surface 341 is configured to be recessed from an outside of the fresh air casing 340 toward an inside of the fresh air casing 340. When the fresh air casing 340 is arranged in a rectangular shape and has a plurality of inner side wall surfaces, at least one of the inner side wall surfaces has a curved surface 341. When the fresh air casing 340 is arranged in a circular shape and has only one inner side wall surface, the inner wall surface of the fresh air casing 340 is a curved surface 341. By making at least one inner side wall surface of the fresh air casing 340 a curved surface 341, the flow of air flow is smoother, and the air resistance and air loss are reduced. By making the curved surface 341 recessed from an outside of the fresh air casing 340 toward an inside of the fresh air casing 340, compared with the convex configuration, the air flow may be prevented from forming turbulence in the fresh air duct 330, thereby further reducing noise.

In an embodiment, as shown in FIGS. 2, 4 and 6, the casing 100 includes a chassis 150, and the fresh air device 300 is installed on the chassis 150. The window air conditioner further includes the compressor 600 that is installed on the chassis 150. The fresh air device 300 and the compressor 600 are disposed on two sides of the chassis 150 in a longitudinal direction of the chassis 150. The chassis 150 provides installation and support for the compressor 600, the heat exchanger and other structures. The compressor 600 usually occupies a large space and has a large weight. By positioning the fresh air device 300 and the compressor 600 on two sides of the chassis 150 in a longitudinal direction of the chassis 150, on the one hand, the layout is more reasonable, the overall arrangement is more compact, and the installation space on the chassis 150 is fully utilized, and on the other hand, the weight distribution on the chassis 150 is more uniform, which prevents deformation of the chassis 150 due to uneven distribution of gravity, and facilitates the installation of the entire machine.

The working system of the entire window air conditioner will be described as follows.

Figure 7:
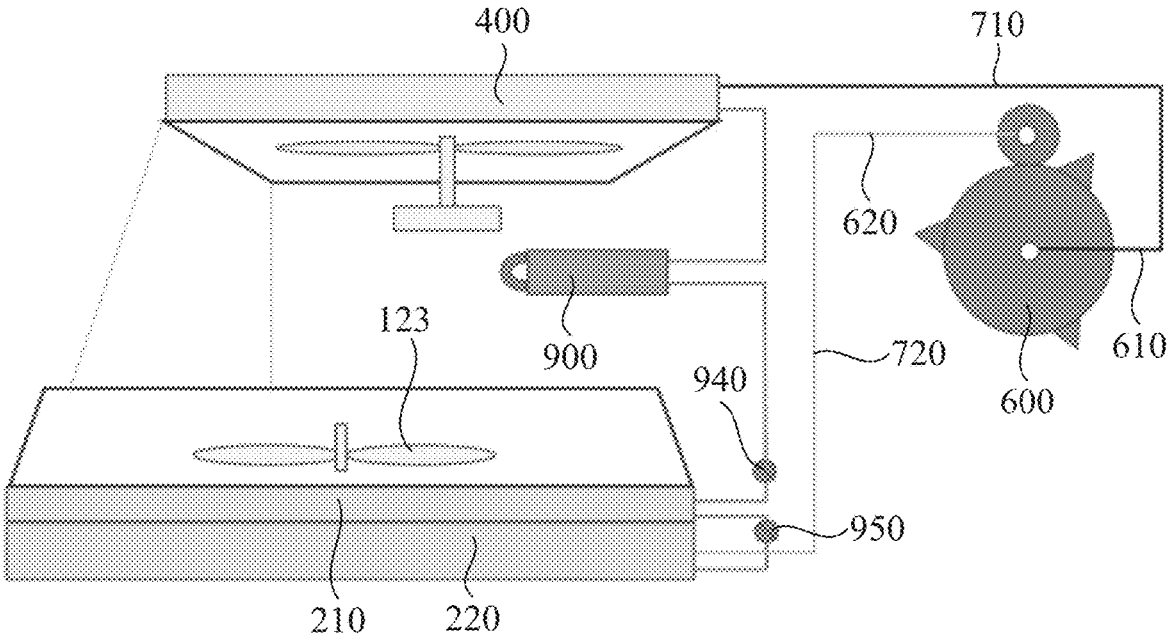
FIG. 7 is a schematic structural view of the window air conditioner according to another embodiment of the present disclosure.

In an embodiment, referring to FIG. 7, the window air conditioner further includes the compressor 600, the outdoor heat exchanger 400, and a refrigerant circulation pipe.

A discharge pipe 610 is provided at a refrigerant outlet of the compressor 600, and a suction pipe 620 is provided at a refrigerant inlet of the compressor 600.

The discharge pipe 610, the outdoor heat exchanger 400, the first indoor heat exchanger 210, the second indoor heat exchanger 220, and the suction pipe 620 are configured to be sequentially communicated with one another through the refrigerant circulation pipe.

In this embodiment, the compressor 600 may be a variable frequency compressor or a fixed frequency compressor. By making the compressor 600 a variable frequency compressor, a dual system of refrigeration and constant temperature dehumidification may be readily achieved, and one compressor can be spared, thereby making the overall structure compact, reducing cost and power, and greatly improving energy efficiency. It can be understood that a first valve 940 may be provided on the refrigerant circulation pipe between the outdoor heat exchanger 400 and the first indoor heat exchanger 210, and a second valve 950 may be provided on the refrigerant circulation pipe between the first indoor heat exchanger 210 and the second indoor heat exchanger 220. The first valve 940 and the second valve 950 may be solenoid valves, electronic expansion valves, or throttle valves, which can control the on-off or flow rate of the piping where they are located. By providing the first valve 940 and the second valve 950, it is possible to control whether the refrigerant flows into the first indoor heat exchanger 210 and the second indoor heat exchanger 220, thereby controlling whether the first indoor heat exchanger 210 and the second indoor heat exchanger 220 participate in cooling or heating.

When the dehumidification mode needs to be turned on, the high-temperature refrigerant from the compressor 600 enters the outdoor heat exchanger 400 (condenser), so that the high-temperature refrigerant from the outdoor heat exchanger 400 reaches the first valve 940. At this time, the first valve 940 may be fully or mostly opened, so that the temperature of the first indoor heat exchanger 210 is equal to or slightly lower than the temperature of the outdoor heat exchanger 400. At this time, the first indoor heat exchanger 210 acts as a condenser to heat the airflow. And then the secondary high-temperature refrigerant flowing out of the first indoor heat exchanger 210 reaches the second valve 950, and the second valve 950 acts as a capillary throttling. After the throttling, the refrigerant turns to low-temperature refrigerant and flows through the second indoor heat exchanger 220. At this time, the second indoor heat exchanger 220 acts as an evaporator to cool the airflow, that is, dehumidify the airflow, and the refrigerant flowing out of the second indoor heat exchanger 220 returns to the compressor 600. In this way, the mixed air of the fresh air and indoor air is heated by the first indoor heat exchanger 210 first, and then cooled and dehumidified by the second indoor heat exchanger 220, and afterwards enters the indoor air duct 110 and is blown out of the indoor air outlet 122, so that the indoor dehumidification is achieved without blowing cold air and the dehumidification effect is better. Certainly, the first indoor heat exchanger 210 may act as an evaporator, and the second indoor heat exchanger 220 may act as a condenser. Then, the fresh air and the indoor air are first cooled and dehumidified, and then heated, and the purpose of constant temperature dehumidification may also be achieved.

When dehumidification is not required and only the cooling mode needs to be turned on, the high-temperature refrigerant flowing out of the compressor 600 enters the outdoor heat exchanger 400 (condenser), so that the high-temperature refrigerant coming out of the outdoor heat exchanger 400 reaches the first valve 940. At this time, a small part of the first valve 940 is opened to play the role of capillary throttling, so that the temperature of the first indoor heat exchanger 210 is much lower than the temperature of the outdoor heat exchanger 400. At this time, the first indoor heat exchanger 210 acts as an evaporator playing the role of cooling. And then the low-temperature refrigerant flowing out of the first indoor heat exchanger 210 reaches the second valve 950. The second valve 950 is fully or mostly opened, playing the role to completely pass or re-throttle. The refrigerant passing through the second valve 950 flows through the second indoor heat exchanger 220. At this time, the second indoor heat exchanger 220 acts as an evaporator, playing the role of secondary cooling. The refrigerant flowing out of the second indoor heat exchanger 220 returns to the compressor 600. In this way, the mixed air of the fresh air and indoor air is cooled by the first indoor heat exchanger 210 first, and then further cooled by the second indoor heat exchanger 220, and afterwards enters the indoor air duct 110 and is blown out of the indoor air outlet 122, so that the rapid cooling of indoor may be achieved.

Figure 8:
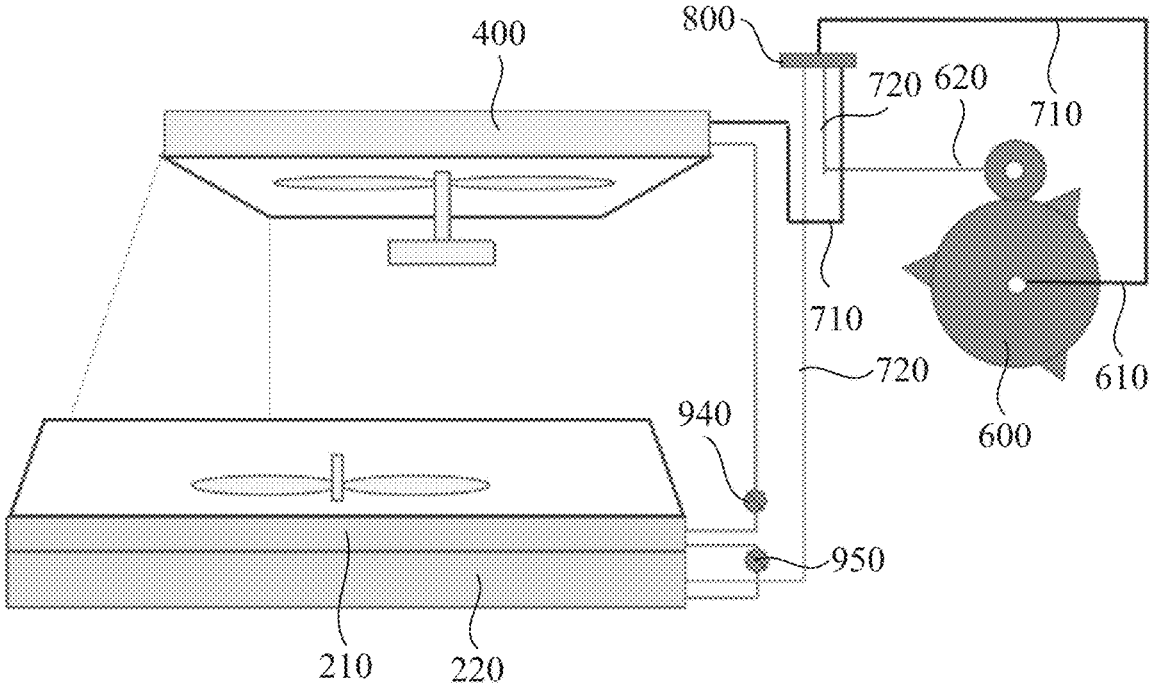
FIG. 8 is a schematic structural view of the window air conditioner according to still another embodiment of the present disclosure.
Figure 9:
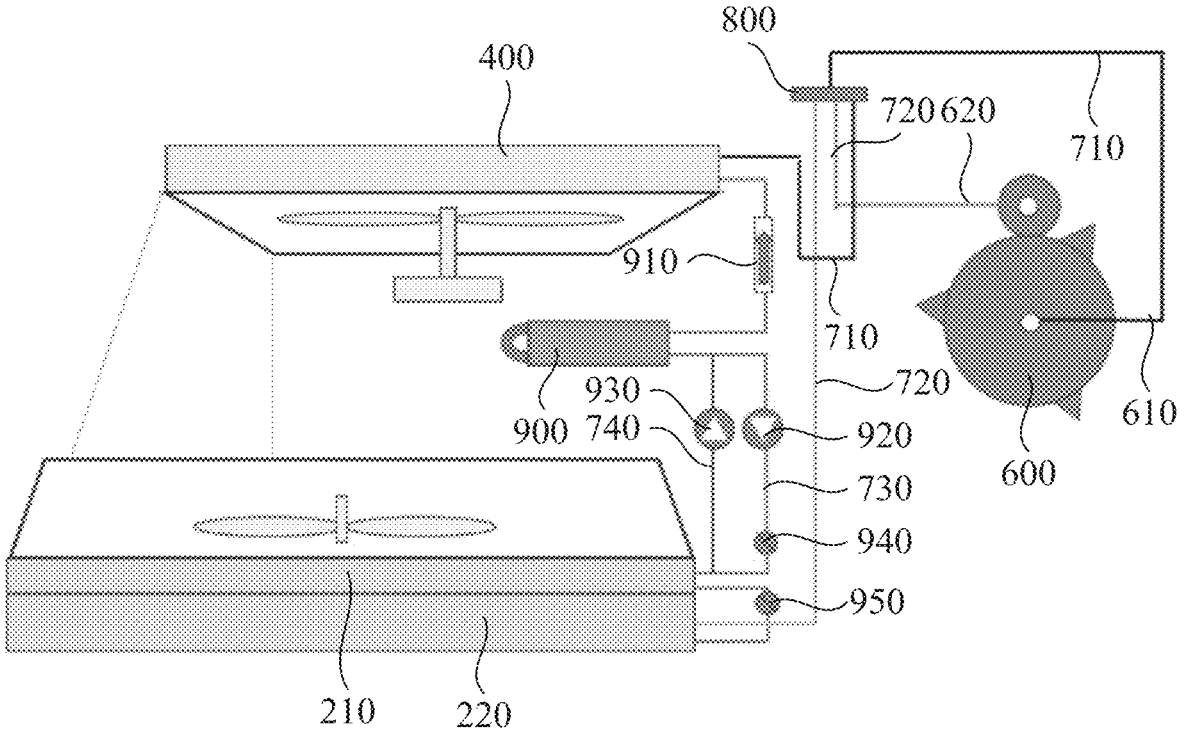
FIG. 9 is a schematic structural view of the window air conditioner according to further another embodiment of the present disclosure.

In an embodiment, as shown in FIGS. 8 and 9, the refrigerant circulation pipe includes a first piping 710 connecting the discharge pipe 610 and the outdoor heat exchanger 400; and a second piping 720 connecting the suction pipe 620 and the second indoor heat exchanger 220. The window air conditioner further includes a switch 800.

The switch 800 is serially connected to the first piping 710 and the second piping 720 and having a first switching state and a second switching state.

In the first switching state, the first piping 710 connected to two ends of the switch 800 is turned on, and the second piping 720 connected to another two ends of the switch 800 is turned on.

In the second switching state, the first piping 710 between the discharge pipe 610 and the switch 800 is configured to be in communication with the second piping 720 between the switch 800 and the second indoor heat exchanger 220, and the first piping 710 between the outdoor heat exchanger 400 and the switch 800 is configured to be in communication with the second piping 720 between the suction pipe 620 and the switch 800.

In this embodiment, the switch 800 may be a four-way valve or other switch 800 so that the refrigerant does not enter the outdoor heat exchanger 400 and the second indoor heat exchanger 220 at the same time. By providing the switch 800, the function of the air conditioner may be enriched. It can be understood that the switch 800 is serially connected to the first piping 710 and the second piping 720, that is, two ends of the switch 800 communicate with the first piping 710, and another two ends of the switch 800 communicate with the second piping 720.

When the switch 800 is in the first switching state, the high-temperature refrigerant flowing out of the discharge pipe 610 of the compressor 600 flows to the outdoor heat exchanger 400 through the first piping 710, and then sequentially flows into the first indoor heat exchanger 210 and the second indoor heat exchanger 220, and finally flows back to the compressor 600 via the second piping 720 and the suction pipe 620. By controlling the opening degrees of the first valve 940 and the second valve 950, the first indoor heat exchanger 210 may be controlled to be in a cooling state or a heating state, so that the entire system may be controlled in a constant temperature dehumidification mode or a dual refrigeration mode.

When the switch 800 is in the second switching state, the high-temperature refrigerant flowing out of the discharge pipe 610 of the compressor 600 flows into the second indoor heat exchanger 220 through the first piping 710 and the second piping 720, and then flows to the first indoor heat exchanger 210 and the outdoor heat exchanger 400, and finally flows back to the compressor 600 through the first piping 710, the second piping 720, and the suction pipe 620. By controlling the opening degrees of the first valve 940 and the second valve 950, the first indoor heat exchanger 210 may be controlled to be in a cooling state or a heating state, so that the entire system may be controlled in a constant temperature dehumidification mode or a dual heating mode. Regarding an embodiment in which it is controlled whether the first indoor heat exchanger 210 is in a cooling state or a heating state through the first valve 940 and the second valve 950, it is similar to the above-mentioned embodiment without switching states, which will not be repeated here.

In an embodiment, referring to FIG. 9 again, the window air conditioner further includes a refrigerant radiator 900, a one-way throttle valve 910, a first one-way valve 920, and a second one-way valve 930.

The refrigerant radiator 900 is serially connected to the refrigerant circulation pipe between the outdoor heat exchanger 400 and the first indoor heat exchanger 210.

The one-way throttle valve 910 is serially connected to the refrigerant circulation pipe between the outdoor heat exchanger 400 and the refrigerant radiator 900. An inlet of the one-way throttle valve 910 is adjacent to the refrigerant radiator 900, and an outlet of the one-way throttle valve 910 is adjacent to the outdoor heat exchanger 400.

The refrigerant circulation pipe further includes a third piping 730 connecting the refrigerant radiator 900 and the first indoor heat exchanger 210; and a fourth piping 740 connecting the refrigerant radiator 900 and the first indoor heat exchanger 210. The fourth piping 740 is arranged in parallel with the third piping 730.

The first one-way valve 920 is configured to be serially connected to the third piping 730. An inlet of the first one-way valve 920 is adjacent to the refrigerant radiator 900, and an outlet of the first one-way valve 920 is adjacent to the first indoor heat exchanger 210.

The second one-way valve 930 is configured to be serially connected to the fourth piping 740. An inlet of the second one-way valve 930 is adjacent to the first indoor heat exchanger 210, and an outlet of the second one-way valve 930 is adjacent to the refrigerant radiator 900.

In this embodiment, it should be noted that the refrigerant radiator 900 may reduce the temperature of the electronic control system and ensure the installability of the electronic control system. The one-way throttle valve 910 means that the flow path is throttled only in one direction, and the entire flow path is completely circulated in the other direction. The one-way throttle valve 910 is serially connected to the refrigerant circulation pipe between the outdoor heat exchanger 400 and the refrigerant radiator 900, and may be unidirectionally throttled from the refrigerant radiator 900 to the outdoor heat exchanger 400, so that the temperature of the refrigerant entering the outdoor heat exchanger 400 may be controlled. The first one-way valve 920 is serially connected to the third piping 730, so that a unidirectional flow path may be provided from the refrigerant radiator 900 to the first indoor heat exchanger 210. The second one-way valve 930 is serially connected to the fourth piping 740, so that a unidirectional flow path may be provided from the first indoor heat exchanger 210 to the refrigerant radiator 900. By providing the one-way throttle valve 910, the first one-way valve 920, and the second one-way valve 930, it can be ensured that the temperature of the refrigerant passing through the refrigerant radiator 900 is not lower than the ambient temperature. By providing the refrigerant radiator 900, the one-way throttle valve 910, the first one-way valve 920, and the second one-way valve 930, heat radiation of the refrigerant as controlled by the electronic control device may be achieved and the condensation may be improved.

The above are only exemplary embodiments of the present disclosure, and do not therefore limit the patent scope of the present disclosure. Under the invention conception of the present disclosure, any equivalent structural transformation made by using the contents of specification and attached drawings of the present disclosure, or directly/indirectly applied in other relevant technical fields, shall be included in the scope of patent protection of the present disclosure.

What is claimed is:

1. A window air conditioner comprising:
a casing defining an indoor air duct;
an indoor heat exchanger, provided inside the casing and comprising:
a first indoor heat exchanger; and
a second indoor heat exchanger;
wherein:
the first indoor heat exchanger and the second indoor heat exchanger are configured to be stacked in an air inlet direction of the indoor air duct; and
in a constant temperature dehumidification mode, one of the first indoor heat exchanger and the second indoor heat exchanger is configured to be in a heating mode, and the other one of the first indoor heat exchanger and the second indoor heat exchanger is configured to be in a cooling mode;
an indoor fan provided inside the indoor air duct; and
a fresh air device, configured to deliver fresh air to the indoor air duct and comprising:
a fresh air inlet, communicating with outdoor air;
a fresh air outlet, communicating with the indoor air duct; and
a fresh air duct, communicating the fresh air inlet and the fresh air outlet,
wherein the casing comprises an indoor casing, where:
the indoor casing defines the indoor air duct;
the fresh air outlet is defined on a rear side wall surface of the indoor casing;
an indoor air inlet is defined on a front side wall surface of the indoor casing; and
the indoor casing defines an indoor air outlet, communicating with the indoor air duct and located above the indoor air inlet, and
wherein the fresh air outlet and the indoor air inlet defined by the indoor casing are located at an air inlet side of the indoor fan, and
wherein the fresh air outlet is arranged relative to the indoor fan and the indoor heat exchanger such that the fresh air directly delivered out of the fresh air outlet is firstly blown out from the indoor air outlet by the indoor fan, the fresh air blown out from the indoor air outlet and mixed with indoor air, and afterwards, the mixed air introduced from the indoor air inlet by the indoor fan is sequentially passed through the first indoor heat exchanger and the second indoor heat exchanger and blown out through the indoor air outlet by the indoor fan.

2. The window air conditioner according to claim 1,
wherein a heat exchange surface of the first indoor heat exchanger is provided corresponding to the indoor air inlet.

3. The window air conditioner according to claim 1, further comprising:
an outdoor air duct, defined inside the casing, an air outlet side of the outdoor air duct being configured to be in communication with the fresh air duct;
an outdoor heat exchanger, provided inside the outdoor air duct; and
an outdoor fan, provided inside the outdoor air duct and configured to send air into the outdoor air duct and the fresh air duct.

4. The window air conditioner according to claim 3, wherein:
the casing further comprises:
an outdoor casing, defining the outdoor air duct; and
the fresh air device comprises:
a fresh air casing, defining the fresh air duct,
wherein:
the fresh air casing is configured to be connected to the outdoor casing, and the fresh air inlet is configured to be defined at a junction between the fresh air casing and the outdoor casing.

5. The window air conditioner according to claim 4, wherein the fresh air casing is provided between the outdoor heat exchanger and the indoor heat exchanger.

6. The window air conditioner according to claim 4, wherein an air-passing area of the fresh air inlet of the fresh air casing is configured to be smaller than an air-pas sing area of the fresh air outlet of the fresh air casing.

7. The window air conditioner according to claim 6, wherein the fresh air casing is configured to be at least partially gradually expanded from the fresh air inlet to the fresh air outlet.

8. The window air conditioner according to claim 7, wherein at least one inner side wall surface of the fresh air casing is configured to be a curved surface, and the curved surface is configured to be recessed from an outside of the fresh air casing toward an inside of the fresh air casing.

9. The window air conditioner according to claim 1, wherein the fresh air device comprises:
a fresh air fan, provided inside the fresh air duct and configured to introduce airflow from the fresh air inlet to the indoor air duct.

10. The window air conditioner according to claim 1, further comprising:

a chassis, the fresh air device being installed on the chassis; and a compressor, installed on the chassis, wherein:

the fresh air device is located on one side of the chassis in a longitudinal direction of the chassis, and the compressor is located on the other side of the chassis in the longitudinal direction of the chassis.

11. The window air conditioner according to claim 3, wherein the casing comprises:

two opposite side walls, at least one of the two opposite side walls defining an outdoor air inlet communicating with an air inlet end of the outdoor air duct; and a rear end wall, connecting the two opposite side walls and defining an outdoor air outlet communicating with an air outlet end of the outdoor air duct.

12. The window air conditioner according to claim 1, wherein an angle between an air supply direction of the indoor air outlet and a horizontal plane is configured to be greater than 0 degrees and less than 90 degrees.

13. The window air conditioner according to claim 1, wherein the indoor air outlet is located on a top side or a lateral side of the indoor casing.

14. The window air conditioner according to claim 1, further comprising:

a compressor comprising a refrigerant inlet and a refrigerant outlet;

an outdoor heat exchanger;

a refrigerant circulation pipe;

a discharge pipe, provided at the refrigerant outlet of the compressor; and a suction pipe, provided at the refrigerant inlet of the compressor, wherein:

the discharge pipe, the outdoor heat exchanger, the first indoor heat exchanger, the second indoor heat exchanger, and the suction pipe are configured to be sequentially communicated with one another through the refrigerant circulation pipe.

15. The window air conditioner according to claim 14, wherein the refrigerant circulation pipe comprises:

a first piping, connecting the discharge pipe and the outdoor heat exchanger; and a second piping, connecting the suction pipe and the second indoor heat exchanger;

wherein:

the window air conditioner further comprises:

a switch, serially connected to the first piping and the second piping and having a first switching state and a second switching state;

wherein:

in the first switching state, the first piping connected to two ends of the switch is configured to be turned on, and the second piping connected to another two ends of the switch is configured to be turned on; and in the second switching state, the first piping between the discharge pipe and the switch is configured to be in communication with the second piping between the switch and the second indoor heat exchanger, and the first piping between the outdoor heat exchanger and the switch is configured to be in communication with the second piping between the suction pipe and the switch.

16. The window air conditioner according to claim 15, further comprising:

a refrigerant radiator, serially connected to the refrigerant circulation pipe between the outdoor heat exchanger and the first indoor heat exchanger;

a one-way throttle valve, serially connected to the refrigerant circulation pipe between the outdoor heat exchanger and the refrigerant radiator, an inlet of the one-way throttle valve being adjacent to the refrigerant radiator, an outlet of the one-way throttle valve being adjacent to the outdoor heat exchanger;

a first one-way valve; and a second one-way valve;

wherein:

the refrigerant circulation pipe further comprises:

a third piping, connecting the refrigerant radiator and the first indoor heat exchanger; and a fourth piping, connecting the refrigerant radiator and the first indoor heat exchanger and arranged in parallel with the third piping;

wherein:

the first one-way valve is configured to be serially connected to the third piping, an inlet of the first one-way valve being adjacent to the refrigerant radiator, an outlet of the first one-way valve being adjacent to the first indoor heat exchanger; and the second one-way valve is configured to be serially connected to the fourth piping, an inlet of the second one-way valve being adjacent to the first indoor heat exchanger, an outlet of the second one-way valve being adjacent to the refrigerant radiator.

* * * * *